US011116333B2

(12) United States Patent
Joardar et al.

(10) Patent No.: US 11,116,333 B2
(45) Date of Patent: Sep. 14, 2021

(54) REFRIGERATED DISPLAY CABINET INCLUDING MICROCHANNEL HEAT EXCHANGERS

(71) Applicant: Carrier Corporation, Palm Beach Gardens, FL (US)

(72) Inventors: Arindom Joardar, Palm Beach Gardens, FL (US); Christophe Valle, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 90 days.

(21) Appl. No.: 16/405,846

(22) Filed: May 7, 2019

(65) Prior Publication Data

US 2020/0352358 A1 Nov. 12, 2020

(51) Int. Cl.
*A47F 3/04* (2006.01)

(52) U.S. Cl.
CPC ..... *A47F 3/0486* (2013.01); *A47F 3/0408* (2013.01); *A47F 3/0434* (2013.01); *A47F 3/0447* (2013.01); *A47F 2003/046* (2013.01)

(58) Field of Classification Search
CPC .... A47F 3/0439; A47F 3/0443; A47F 3/0452; A47F 3/0469; A47F 3/0447; A47F 3/0456; A47F 2003/0473; F25D 23/006; F25D 11/02; F25B 5/02
See application file for complete search history.

(56) References Cited

U.S. PATENT DOCUMENTS 2,494,481 A 1/1950 MacMaster et al.
2,657,546 A 11/1953 Smith
2,672,735 A 3/1954 Fusselman
2,750,758 A 6/1956 Hoye et al.
2,838,809 A 6/1958 Zeolla et al.
3,091,942 A 6/1963 Dickson et al.
3,103,796 A 9/1963 Dickson et al.
3,111,817 A 11/1963 Solley, Jr.
3,186,185 A 6/1965 Bently et al.
3,444,698 A 5/1969 Lorenz
3,462,966 A 8/1969 Reid et al.
3,531,945 A * 10/1970 Brennan ..... F25D 17/06 62/234

(Continued)

FOREIGN PATENT DOCUMENTS

BR 102015028925 5/2017
CN 86103298 11/1986

(Continued)

OTHER PUBLICATIONS

US 8,764,130 B1, 07/2014, Pack et al. (withdrawn)
European Search Report for Application No. 20173284.9 dated Jul. 3, 2020.

*Primary Examiner* — David J Teitelbaum
(74) *Attorney, Agent, or Firm* — Carlson, Gaskey & Olds, P.C.

(57) ABSTRACT

A refrigerated display case includes a housing surrounding multiple shelves. An air return passage is defined below the shelves. A fan is disposed at a downstream end of the air return passage. An air distribution gap is connected to an outlet of the fan and disposed behind the shelves and a top passage is disposed above the shelves. At least one micro-channel heat exchanger connects the air distribution gap to the shelves.

19 Claims, 4 Drawing Sheets

(56) References Cited

U.S. PATENT DOCUMENTS

| | | | | |
|---|---|---|---|---|
| 3,577,744 | A | 5/1971 | Mercer | |
| 3,848,426 | A | 11/1974 | Whitney | |
| 3,893,307 | A | 7/1975 | Jacobs | |
| 3,898,864 | A | 8/1975 | Steelman | |
| 4,004,370 | A | 1/1977 | Heaney | |
| 4,009,586 | A | 3/1977 | Skvarenina | |
| 4,035,608 | A | 7/1977 | Stromquist et al. | |
| 4,117,698 | A | 10/1978 | Vogel | |
| 4,127,765 | A | 11/1978 | Heaney | |
| 4,135,369 | A * | 1/1979 | Allgeyer | A47F 3/04 62/251 |
| 4,150,550 | A | 4/1979 | Mercer, Sr. | |
| 4,197,718 | A | 4/1980 | Abraham et al. | |
| 4,245,482 | A | 1/1981 | Abraham | |
| 4,248,015 | A | 2/1981 | Stromquist et al. | |
| 4,265,090 | A | 5/1981 | Abraham | |
| 4,272,969 | A | 6/1981 | Schwitzgebel | |
| 4,302,946 | A | 12/1981 | Ibrahim | |
| 4,312,190 | A | 1/1982 | Ibrahim et al. | |
| 4,319,463 | A | 3/1982 | Ljung | |
| 4,341,082 | A | 7/1982 | Ibrahim | |
| 4,347,710 | A | 9/1982 | Ibrahim | |
| 4,375,155 | A | 3/1983 | Rosanio et al. | |
| 4,389,852 | A | 6/1983 | Abraham | |
| 4,389,856 | A | 6/1983 | Ibrahim | |
| 4,414,822 | A | 11/1983 | Ibrahim | |
| 4,474,017 | A | 10/1984 | Prada | |
| 4,592,209 | A | 6/1986 | Casanova et al. | |
| 4,741,172 | A | 5/1988 | Aoki | |
| 4,750,335 | A | 6/1988 | Wallace et al. | |
| 4,782,666 | A | 11/1988 | Costan | |
| 4,855,567 | A | 8/1989 | Mueller | |
| 4,879,881 | A | 11/1989 | Madigan | |
| 4,938,034 | A | 7/1990 | Rosanio et al. | |
| 4,949,554 | A | 8/1990 | Branz et al. | |
| 4,998,382 | A | 3/1991 | Kostos et al. | |
| 5,009,080 | A | 4/1991 | Naganuma et al. | |
| 5,031,413 | A | 7/1991 | Tsuihiji et al. | |
| 5,097,642 | A | 3/1992 | Richardson et al. | |
| 5,203,175 | A | 4/1993 | Farrey et al. | |
| 5,329,736 | A | 7/1994 | Sodervall | |
| 5,606,863 | A | 3/1997 | Kicklighter et al. | |
| 5,704,221 | A | 1/1998 | Lego | |
| 5,727,393 | A | 3/1998 | Mahmoudzadeh | |
| 5,743,098 | A | 4/1998 | Behr | |
| 5,778,689 | A | 7/1998 | Beatenbough | |
| 5,791,152 | A * | 8/1998 | Choi | A47F 3/0447 62/89 |
| 5,867,994 | A | 2/1999 | Kopko | |
| 5,931,013 | A | 8/1999 | Wickman | |
| 6,144,017 | A | 11/2000 | Millett et al. | |
| 6,151,904 | A | 11/2000 | Jin | |
| 6,185,958 | B1 | 2/2001 | Wightman | |
| 6,311,512 | B1 | 11/2001 | Fung et al. | |
| 6,435,630 | B1 | 8/2002 | Anin et al. | |
| 6,460,372 | B1 | 10/2002 | Fung et al. | |
| 6,547,346 | B2 | 4/2003 | Topper et al. | |
| 6,615,593 | B2 | 9/2003 | Thurman | |
| 6,718,778 | B2 | 4/2004 | Lawrence | |
| 6,912,864 | B2 | 7/2005 | Roche et al. | |
| 6,981,385 | B2 | 1/2006 | Arshansky et al. | |
| 7,003,920 | B1 | 2/2006 | Messere et al. | |
| 7,143,605 | B2 * | 12/2006 | Rohrer | F25B 5/02 62/515 |
| 7,207,181 | B2 | 4/2007 | Murray et al. | |
| 7,275,376 | B2 | 10/2007 | Swofford et al. | |
| 7,281,387 | B2 | 10/2007 | Daddis, Jr. et al. | |
| 7,340,907 | B2 | 3/2008 | Vogh, III | |
| 7,367,198 | B2 | 5/2008 | Behr | |
| 7,614,249 | B2 | 11/2009 | Hu | |
| 7,891,153 | B2 | 2/2011 | Cording | |
| 7,891,154 | B2 | 2/2011 | Cording | |
| 7,905,101 | B2 | 3/2011 | Sunderland et al. | |
| 7,997,094 | B2 | 8/2011 | Zangari et al. | |
| 8,057,615 | B2 | 11/2011 | Grussaute-Nghiem et al. | |
| 8,104,302 | B2 | 1/2012 | Hayase et al. | |
| 8,151,587 | B2 | 4/2012 | Chiang et al. | |
| 8,215,921 | B2 | 7/2012 | Coonrod | |
| 8,250,873 | B2 | 8/2012 | Yoon et al. | |
| 8,359,876 | B2 | 1/2013 | Esformes | |
| 8,534,006 | B2 | 9/2013 | Roche et al. | |
| 8,539,783 | B1 | 9/2013 | Bunch | |
| 8,613,161 | B2 | 12/2013 | Nicholson et al. | |
| 8,677,771 | B2 | 3/2014 | Li et al. | |
| 8,769,970 | B2 | 7/2014 | Fung et al. | |
| 8,776,443 | B2 | 7/2014 | Bienick | |
| 8,997,507 | B2 | 4/2015 | Boarman | |
| 9,046,294 | B2 | 6/2015 | Lee et al. | |
| 9,157,675 | B2 | 10/2015 | Howington et al. | |
| 9,217,600 | B2 | 12/2015 | Malisi | |
| 9,456,705 | B2 | 10/2016 | Zangari et al. | |
| 9,578,977 | B2 | 2/2017 | Smith | |
| 9,964,350 | B2 | 5/2018 | Rees et al. | |
| 10,039,390 | B2 | 8/2018 | Artwohl et al. | |
| 2001/0003248 | A1 | 6/2001 | Otto et al. | |
| 2003/0172670 | A1 * | 9/2003 | Vormedal | F25D 23/023 62/407 |
| 2005/0229614 | A1 | 10/2005 | Ansted | |
| 2006/0103269 | A1 | 5/2006 | Artwohl et al. | |
| 2007/0077399 | A1 | 4/2007 | Borowiec et al. | |
| 2007/0289323 | A1 | 12/2007 | Swofford et al. | |
| 2008/0104973 | A1 | 5/2008 | Hall et al. | |
| 2009/0205351 | A1 | 8/2009 | Fung | |
| 2010/0199686 | A1 | 8/2010 | Taras et al. | |
| 2010/0200150 | A1 | 8/2010 | Ougitani et al. | |
| 2010/0300127 | A1 | 12/2010 | Gu et al. | |
| 2012/0067072 | A1 | 3/2012 | Malwitz et al. | |
| 2013/0213073 | A1 * | 8/2013 | Fritz | F28D 1/05383 62/255 |
| 2014/0069125 | A1 | 3/2014 | Chikkakalbalu et al. | |
| 2014/0260360 | A1 | 9/2014 | Rasch | |
| 2015/0285551 | A1 | 10/2015 | Aiken et al. | |
| 2016/0360900 | A1 | 12/2016 | Hoist et al. | |
| 2017/0020305 | A1 | 1/2017 | Fischer | |
| 2017/0208966 | A1 | 7/2017 | Reichert | |

FOREIGN PATENT DOCUMENTS

| | | |
|---|---|---|
| CN | 1050604 | 4/1991 |
| CN | 2223463 | 3/1996 |
| CN | 1311420 | 9/2001 |
| CN | 2583582 | 10/2003 |
| CN | 2583584 | 10/2003 |
| CN | 2583585 | 10/2003 |
| CN | 101093129 | 12/2007 |
| CN | 102297565 | 12/2011 |
| CN | 102379580 | 3/2012 |
| CN | 104654671 | 5/2015 |
| CN | 204478635 | 7/2015 |
| CN | 204923650 | 12/2015 |
| CN | 205037628 | 2/2016 |
| CN | 205448463 | 8/2016 |
| CN | 106595196 | 4/2017 |
| CN | 10693186 | 7/2017 |
| CN | 107101436 | 8/2017 |
| CN | 207455994 | 6/2018 |
| CN | 106545269 | 9/2018 |
| DE | 2934457 | 3/1981 |
| EP | 0527500 | 2/1993 |
| EP | 0717945 | 6/1996 |
| EP | 1029478 | 8/2000 |
| EP | 1203551 | 5/2002 |
| EP | 1414327 | 5/2004 |
| EP | 2310773 | 4/2011 |
| FR | 1282235 | 1/1962 |
| FR | 1386573 | 1/1965 |
| FR | 2443228 | 7/1980 |
| FR | 2488500 | 2/1982 |
| FR | 2525886 | 11/1983 |
| GB | 796626 | 6/1958 |
| GB | 2167846 | 6/1986 |
| GB | 2210683 | 6/1989 |
| IN | 2690DEL2010 | 11/2012 |
| JP | H10253229 | 9/1998 |

(56) References Cited

FOREIGN PATENT DOCUMENTS

| | | |
|---|---|---|
| JP | 2000018796 | 1/2000 |
| JP | 2004000372 | 1/2004 |
| KR | 1019990038394 | 6/1996 |
| WO | 0053062 | 9/2000 |
| WO | 2006087690 | 8/2006 |
| WO | 2015165512 | 11/2015 |
| WO | 2018034846 | 2/2018 |
| WO | 2018093764 | 5/2018 |

* cited by examiner

REFRIGERATED DISPLAY CABINET INCLUDING MICROCHANNEL HEAT EXCHANGERS

TECHNICAL FIELD

The present disclosure relates generally to refrigerated display cabinets, and more specifically to a flat tube microchannel heat exchanger configuration for medium-temperature refrigerated merchandisers.

BACKGROUND

In practice, grocery stores and supermarkets use refrigerated merchandisers of different types, which may be open or with doors, for displaying and presenting fresh food and beverages to the customers, while maintaining a desired temperature of the products below a predefined threshold. In order to maintain the low temperature, cold air is circulated to the product display area of the cabinet by passing airflow over a heat exchanger surface of an evaporator. A cold refrigerant is pumped through the internal passages of the tubes which absorb the heat from the air via fins and tube surfaces and the refrigerant changes from a liquid phase to a vapor phase in the process. As a result, the temperature of the air passing through the evaporator is lowered. One or more fans are typically included in the base of the refrigerated display cabinet and drive cold air through the heat exchanger, and deliver the cold air to the product display area of the merchandiser.

SUMMARY OF THE INVENTION

In one exemplary embodiment a refrigerated display case includes a housing surrounding a plurality of shelves, an air return passage defined below the plurality of shelves, a fan disposed at a downstream end of the air return passage, an air distribution gap connected to an outlet of the fan and disposed behind the plurality of shelves and a top passage disposed above the plurality of shelves, and at least one microchannel heat exchanger connecting the air distribution gap to the plurality of shelves.

In another example of the above described refrigerated display case the top passage is segregated from the air distribution gap by a first microchannel heat exchanger of the at least one microchannel heat exchanger.

In another example of any of the above described refrigerated display cases an outlet of each microchannel heat exchanger in the at least one microchannel heat exchanger is provided directly to at least one corresponding shelf.

Another example of any of the above described refrigerated display cases further includes at least one distribution plate connecting an outlet of at least one of the microchannel heat exchangers in the at least one microchannel heat exchangers to the at least one corresponding shelf.

In another example of any of the above described refrigerated display cases the at least one distribution plate includes a plurality of distribution holes.

In another example of any of the above described refrigerated display cases the at least one distribution plate includes a plurality of plates, and the plurality of plates includes a plurality of distribution holes.

Another example of any of the above described refrigerated display cases further includes an air curtain fan disposed at a downstream end of the top passage.

Another example of any of the above described refrigerated display cases further includes a microchannel heat exchanger disposed immediately upstream of the air curtain fan.

In another example of any of the above described refrigerated display cases the at least one microchannel heat exchanger comprises a plurality of microchannel heat exchangers, and wherein each microchannel heat exchanger in the plurality of microchannel heat exchangers is on a shared coolant circuit.

In another example of any of the above described refrigerated display cases the at least one microchannel heat exchanger comprises a plurality of microchannel heat exchangers, and wherein the plurality of microchannel heat exchangers includes a first coolant circuit and a second coolant circuit distinct from the first coolant circuit.

In another example of any of the above described refrigerated display cases the fan is an axial flow fan.

Another example of any of the above described refrigerated display cases further includes an at least partially transparent door enclosing the housing.

An exemplary method for cooling a storage space in a refrigerated cabinet includes driving uncooled air into a distribution gap behind a plurality of shelves in a refrigerated cabinet, passing a portion of the uncooled air through at least one microchannel heat exchanger connecting the distribution gap to a corresponding shelf in the plurality of shelves, thereby cooling the air, and passing a portion of the uncooled air through a first microchannel heat exchanger in the at least one microchannel heat exchanger, thereby providing cooled air to a top passage disposed above the plurality of shelves.

In another example of the above described method for cooling a storage space in a refrigerated cabinet passing the portion of the uncooled air through at least one microchannel; heat exchanger comprises providing the cooled air directly from an output of the microchannel heat exchanger to the corresponding shelf.

Another example of any of the above described methods for cooling a storage space in a refrigerated cabinet further includes connecting an output of the at least one microchannel heat exchanger to the corresponding shelf via at least one distribution plate.

In another example of any of the above described methods for cooling a storage space in a refrigerated cabinet the at least one microchannel heat exchanger includes a plurality of microchannel heat exchangers, and further includes connecting an output of a second microchannel heat exchanger in the plurality of microchannel heat exchangers to an air curtain fan, thereby providing cooled air to the air curtain fan.

Another example of any of the above described methods for cooling a storage space in a refrigerated cabinet further includes operating the air curtain fan to create an air curtain in response to detecting an open door.

In another example of any of the above described methods for cooling a storage space in a refrigerated cabinet the at least one microchannel heat exchanger includes a plurality of microchannel heat exchangers, and wherein each microchannel heat exchanger in the plurality of microchannel heat exchangers is configured to be controlled independently by a controller.

In another example of any of the above described methods for cooling a storage space in a refrigerated cabinet each microchannel heat exchanger in the plurality of microchannel heat exchangers controls a temperature of at least one corresponding shelf.

These and other features of the present invention can be best understood from the following specification and drawings, the following of which is a brief description.

DETAILED DESCRIPTION

Figure 1:
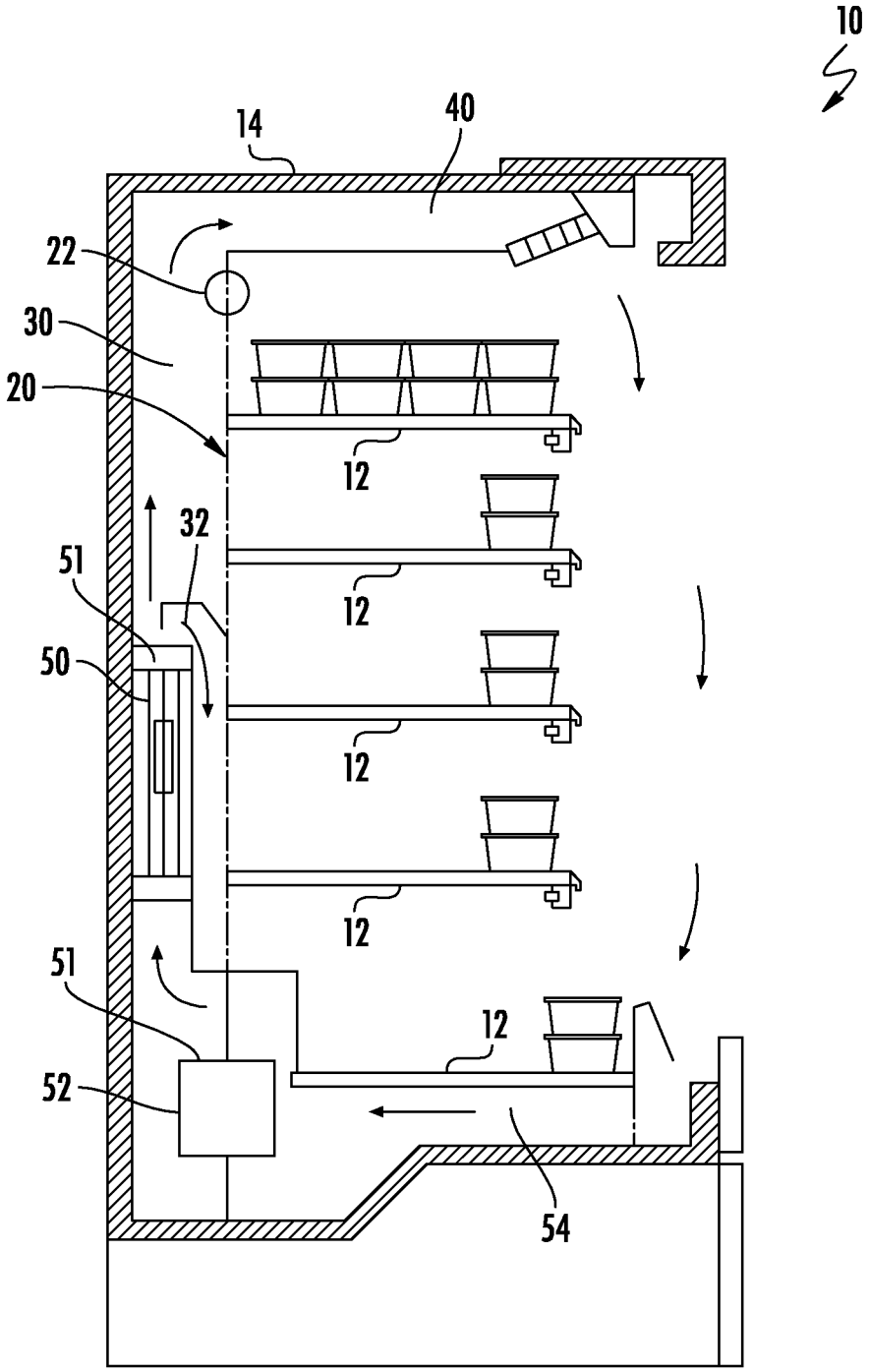
FIG. 1 PRIOR ART
FIG. 1 illustrates a prior art refrigerated display cabinet.

FIG. 1 schematically illustrates an exemplary prior art refrigerated display cabinet 10. The prior art cabinet 10 includes multiple shelves 12 contained within a cabinet housing 14. Each of the shelves 12 faces a front opening 16, and is supported at a rear end by a sheet metal distribution plate 20. The interior rear sheet metal distribution plate 20 defines a substantially vertical passage 30 in the rear of the cabinet 10, and a substantially horizontal passage 40 at the top of the cabinet 10. As there is no obstruction between the passage 30 and the passage 40, the two passages 30, 40 combine to define a single fluidly connected cooled air space. The distribution plate 20 includes multiple distribution holes 22 that allow cooled air to pass from the rear of the passage 30 into a corresponding shelf 12 region.

Also included within the passage 30 is a round-tube plate-fin heat exchanger 50 for cooling the air being provided to the shelves 12. A fan 52 is positioned immediately downstream of the heat exchanger 50 at an aft end of a return cavity 54 below the bottom most shelf 12. The fan 52 drives all of the air from the return cavity 54 to pass through the heat exchanger 50, thereby causing all of the air to be cooled. An aft end 51 of the heat exchanger 50 expels cooled air into the passage 30. A portion of the air flows upward through the passage 30 to the top passage 40 and the top shelves 12. A redirection feature 32 alters a flow direction of another portion of the cooled air by 180 degrees such that the redirected cooled air is provided to the lower shelves 12.

The size of the passage 30 is dictated by the size of the heat exchanger 50, and the space between the heat exchanger 50 and the distribution plate 20 required to allow sufficient air to be provided to each shelf 12. Further, as all of the air is cooled by the single heat exchanger 50, the heat exchanger 50 must be sufficiently sized to cool all of the air to a temperature that remains below the required temperature until it reaches the farthest shelf 12 from the heat exchanger 50. This can result in overcooling the middle shelves in order to achieve the desired cooling at the top and/or bottom shelves 12. Even further still, the travel from the output of the heat exchanger 50 to each of the shelves 12 where the cooling is required causes the temperature of the air provided to the shelves 12 to be higher than the outlet temperature of the heat exchanger 50.

Figure 2:
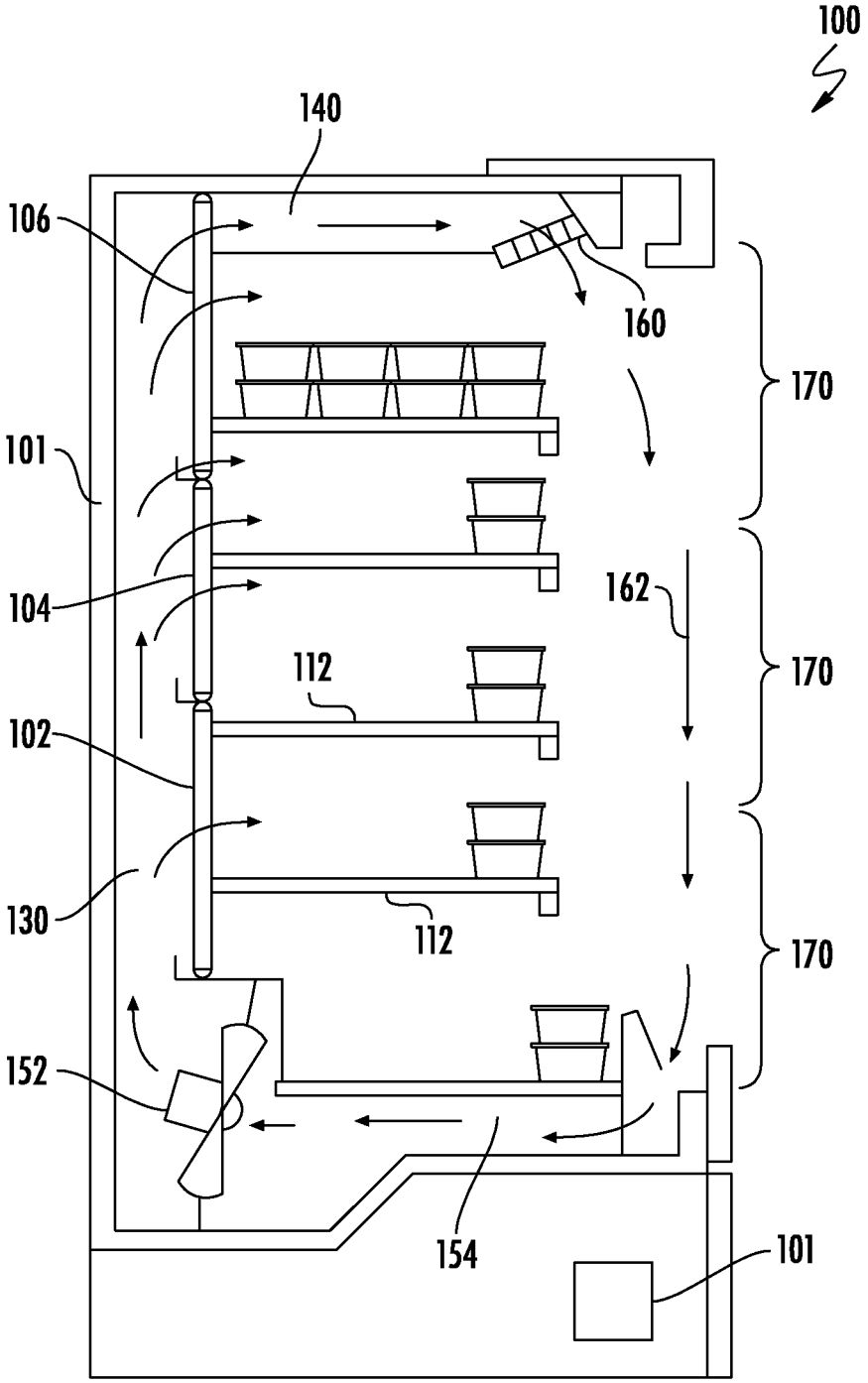
FIG. 2 schematically illustrates a first example configuration of a refrigerated display cabinet.

With continued reference to prior art FIG. 1, FIG. 2 schematically illustrates an exemplary modified refrigerated display cabinet 100 utilizing a plurality of microchannel heat exchangers 102, 104, 106 to cool the air provided to the shelves 12. As used herein, a microchannel heat exchanger is a flat tube heat exchanger. A flat tube heat exchanger includes an inlet manifold and an outlet manifold fluidly connected by a plurality of flat tubes. The flat tubes may be formed to include a plurality of channels, or internal passageways that are much smaller than the internal passageways of the tubes in a conventional round-tube plate-fin heat exchanger, such as the heat exchanger 50 of the prior art example 50.

As used herein, the flat tube heat exchangers may also comprise mini size multi-port channels, or micro size multi-port channels (otherwise known as microchannel tubes).

Hence the flat tube heat exchangers using small size multi-port channels are alternately known as Microchannel Heat Exchanger 102, 104, 106. However, in other constructions, the flat tube heat exchangers may include one channel, or internal passageway. In such an example, the microchannel heat exchanger 102, 104, 106 includes multiple secondary heat transfer surfaces in the form of serpentine-shape fins with louvers. The fins encompasses the width of the tube which also defines the minor dimension of the microchannel heat exchanger 102, 104, 106 and through which the air flows. In one example, the fins are positioned along the flat tubes and solidly coupled to two adjacent flat tubes by a brazing or welding process. In the example of FIG. 2, the microchannel heat exchangers 102, 104, 106 replace the distribution plate 20. Both the microchannel evaporators 102, 104, 106 and the shelves 112 are structurally supported by common vertical columns (not shown). The topmost microchannel heat exchanger 106 further extends upward past the top most shelf 112 and separates a passage 130 behind the shelves 112 from a passage 140 defined above the shelves 112. This separation allows the airflow in the passage 130 to remain uncooled, while still providing cooled air to the top passage 140 needed for the operation of the air-curtain 162. Air is driven from a return cavity 154 to the gap 130 by an axial flow fan 152.

This configuration allows airflow in the passage 130 to remain unrefrigerated and provides a significant reduction of conduction heat losses through a rear exterior wall 101. Approximately 5% of the heat losses in a medium temperature refrigerated merchandiser is attributable to the conduction heat losses through the exterior wall 101. Hence unrefrigerated air in passage 130 improves the energy efficiency of the display cabinets.

Furthermore, in conventional refrigerated merchandisers, large amount of insulation material is used in the exterior wall 101 which deteriorates with time and adds to the cost of these units. The need for high grade and large quantity of insulation is significantly reduced when the airflow in passage 130 is unrefrigerated. Thus, high cost savings can be realized by relaxation of the needs to insulate the exterior wall 101.

As the exemplary refrigerated display case of FIG. 2 is an open faced case, an air driving fan 160 is positioned at a forward end of the top gap 140, and angled such that cooled air is driven downward in front of the shelves 112. The air driven in front of the shelves 112 creates an air curtain and keeps the cooled air within the refrigerated display case 100. In an alternate example, a door can be included, and the air curtain can be operated by a controller 101 that detects when the door has been opened such that the air curtain is only active while the door is open.

Each of the microchannel heat exchangers 102, 104, 106 provides cooled air directly to the corresponding shelves 112 and there is no warming between the output air from the heat exchanger 102, 104, 106 and the corresponding shelves 112. This allows the air provided to each shelf 112 to be cooled only to the necessary cooling level for that shelf, and prevents overcooling of the air thereby reducing the energy consumption of the merchandiser. Further, due to the inclusion of distinct microchannel heat exchangers 112, multiple distinct zones 170 can be controlled by a controller 101 to operate at distinct temperatures. While illustrated in the exemplary embodiment as including three microchannel heat exchangers 102, 104, 106, a practical embodiment can include alternate numbers of microchannel heat exchangers. In one example, each shelf 112 can be a distinct zone with its own corresponding microchannel heat exchanger. In alternative examples, numbers as low as two microchannel heat exchangers can be utilized.

Figure 3:
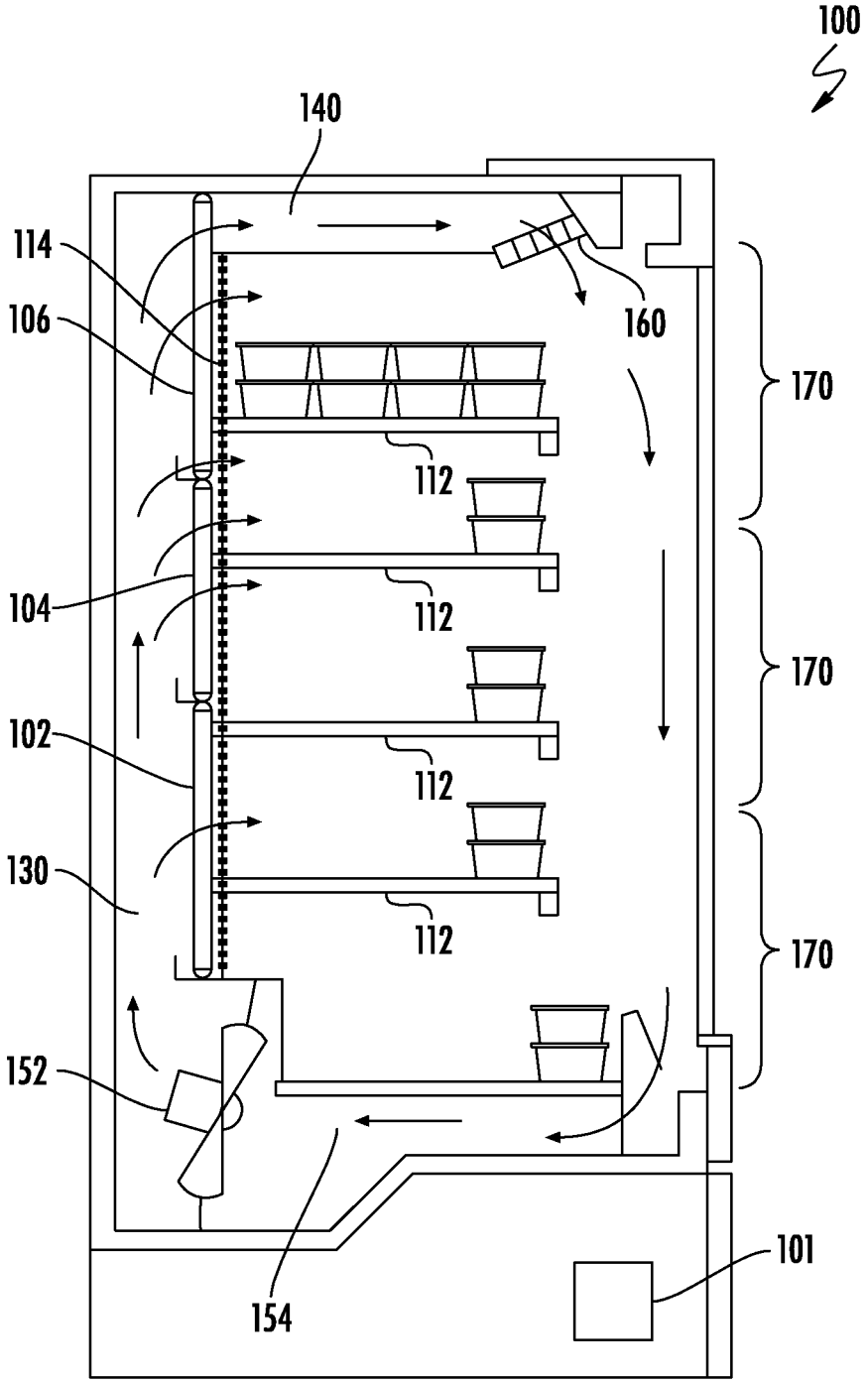
FIG. 3 schematically illustrates a second example configuration of a refrigerated display cabinet.

With continued reference to FIG. 2, FIG. 3 schematically illustrates an alternate embodiment including all of the features of FIG. 2, with the addition of one or more distribution plates 114 immediately downstream of the microchannel heat exchangers 112. The distribution plate(s) 114 can be a single sheet with multiple holes distributed about the sheet, or a distinct distribution sheet for each shelf 112, with each distinct sheet having a specific hole distribution configured to meter and target the corresponding shelf 112 for a given airflow.

The refrigerator display case 100 of FIG. 3 includes a glass door 180 enclosing the front of the refrigerated display case 100. The air directing fan 160 is maintained and provides an air curtain while the door 180 is open in order to further maintain the cool temperature within the refrigerated display case 100. In some examples, the controller 101 can constantly drive air at a sufficient rate to create the air curtain even while the door is closed. In other examples, the controller 101 can drive the air at a lower rate while the door is closed to enhance circulation, and can increase the rate of air being driven when the door is opened to create the air curtain.

With reference now to FIGS. 2 and 3, in some embodiments each of the microchannel heat exchangers 102, 104, 106 can be connected to a single coolant circuit, and a single coolant source is provides cooling to each heat exchanger 102, 104, 106. In alternative embodiments, each microchannel heat exchanger 102, 104, 106 can be a distinct, independently controlled coolant circuit including its own independent coolant supply. In yet further examples where three or more heat exchangers 102, 104, 106 are utilized, a subset of the heat exchangers 102, 104, 106 can be on independent coolant circuits, while a remainder of the heat exchangers 102, 104, 106 are within a single coolant circuit.

Figure 4:
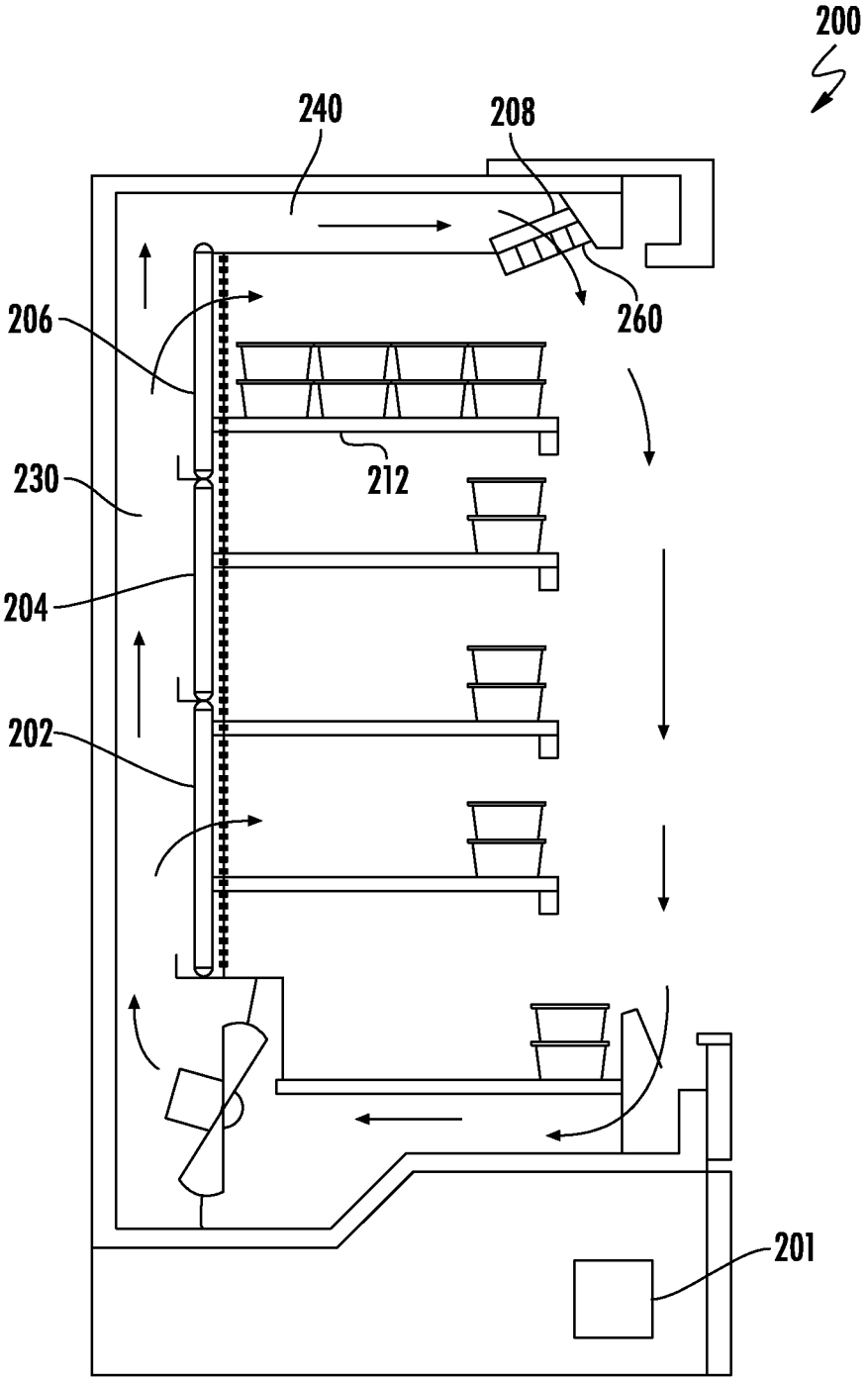
FIG. 4 schematically illustrates a third example configuration of a refrigerated display cabinet.

With continued reference to FIGS. 2 and 3, FIG. 4 schematically illustrates another embodiment of a refrigerated display case 200 including microchannel heat exchangers 202, 204, 206 to generate the cooled air. In the variation of FIG. 4, the topmost microchannel heat exchanger 106 extends only to the top of the top shelf 212, and the rear passage 230 and the top passage 240 are fluidly connected. In order to provide cool air at the air curtain, an additional microchannel heat exchanger 208 is included immediately upstream of the air directing fan 260 that generates the air curtain. In this configuration, the rear passage 230, and the top passage 240 are a single unrefrigerated air passage, and the air is cooled immediately prior to being utilized in each location.

As with the example of FIGS. 2 and 3, the refrigerated cabinet 200 includes a controller 210 capable of controlling the microchannel heat exchangers 202, 204, 206, 208 and able to control the fan 260 for generating the air curtain. Further, the cabinet 200 can include a glass door, or be an open cabinet depending on the needs of a particular application.

As with the examples of FIGS. 2 and 3, the microchannel heat exchangers 202, 204, 206, 208 can be contained within a single coolant circuit, or included on their own coolant circuits. In one particular example, the air curtain microchannel heat exchanger 208 is provided with a distinct coolant circuit from the remainder of the microchannel heat exchangers 202, 204, 206 in order to accommodate the remote positioning of the microchannel heat exchanger 208 relative to the remainder.

With reference to FIGS. 2, 3 and 4, the described embodiments further allow a decrease in system cost due to a lower coil cost, lighter weight, higher efficiency, and more stable shelf temperatures than the systems realized by the prior rat. The more stable shelf temperatures further reduce deterioration of food, or other temperature sensitive items on a given shelf 112, 212. Further, the removal of the large heat exchanger form the rear gap 130, 230 allows for each shelf 112, 212 to include more storage space without increasing the size of the overall cabinet 100, 200 due to the smaller form factor of the microchannel heat exchangers.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A refrigerated display case comprising:

a housing surrounding a plurality of shelves;

an air return passage defined below the plurality of shelves;

a fan disposed at a downstream end of the air return passage;

an air distribution gap connected to an outlet of the fan and disposed behind the plurality of shelves and a top passage disposed above the plurality of shelves; and at least one microchannel heat exchanger connecting the air distribution gap to the plurality of shelves.

2. The refrigerated display case of claim 1, wherein the top passage is segregated from the air distribution gap by a first microchannel heat exchanger of said at least one microchannel heat exchanger.

3. The refrigerated display case of claim 1, wherein an outlet of each microchannel heat exchanger in the at least one microchannel heat exchanger is provided directly to at least one corresponding shelf.

4. The refrigerated display case of claim 3, further comprising at least one distribution plate connecting an outlet of at least one of the microchannel heat exchangers in the at least one microchannel heat exchangers to the at least one corresponding shelf.

5. The refrigerated display case of claim 4, wherein the at least one distribution plate includes a plurality of distribution holes.

6. The refrigerated display case of claim 4, wherein the at least one distribution plate includes a plurality of plates, and said plurality of plates includes a plurality of distribution holes.

7. The refrigerated display case of claim 1, further comprising an air curtain fan disposed at a downstream end of the top passage.

8. The refrigerated display case of claim 7, further comprising a microchannel heat exchanger disposed immediately upstream of the air curtain fan.

9. The refrigerated display case of claim 1, wherein the at least one microchannel heat exchanger comprises a plurality of microchannel heat exchangers, and wherein each microchannel heat exchanger in the plurality of microchannel heat exchangers is on a shared coolant circuit.

10. The refrigerated display case of claim 1, wherein the at least one microchannel heat exchanger comprises a plurality of microchannel heat exchangers, and wherein the plurality of microchannel heat exchangers includes a first coolant circuit and a second coolant circuit distinct from the first coolant circuit.

11. The refrigerator display case of claim 1, wherein the fan is an axial flow fan.

12. The refrigerator display case of claim 1, further comprising an at least partially transparent door enclosing the housing.

13. A method for cooling a storage space in a refrigerated cabinet comprising:

driving uncooled air into a distribution gap behind a plurality of shelves in a refrigerated cabinet;

passing a portion of the uncooled air through at least one microchannel heat exchanger connecting the distribution gap to a corresponding shelf in the plurality of shelves, thereby cooling the air; and passing a portion of the uncooled air through a first microchannel heat exchanger in the at least one microchannel heat exchanger, thereby providing cooled air to a top passage disposed above the plurality of shelves.

14. The method of claim 13, wherein passing the portion of the uncooled air through at least one microchannel; heat exchanger comprises providing the cooled air directly from an output of the microchannel heat exchanger to the corresponding shelf.

15. The method of claim 13, further comprising connecting an output of the at least one microchannel heat exchanger to the corresponding shelf via at least one distribution plate.

16. The method of claim 13, wherein the at least one microchannel heat exchanger includes a plurality of microchannel heat exchangers, and further comprising connecting an output of a second microchannel heat exchanger in the plurality of microchannel heat exchangers to an air curtain fan, thereby providing cooled air to the air curtain fan.

17. The method of claim 16, further comprising operating the air curtain fan to create an air curtain in response to detecting an open door.

18. The method of claim 13, wherein the at least one microchannel heat exchanger includes a plurality of microchannel heat exchangers, and wherein each microchannel heat exchanger in the plurality of microchannel heat exchangers is configured to be controlled independently by a controller.

19. The method of claim 18, wherein each microchannel heat exchanger in the plurality of microchannel heat exchangers controls a temperature of at least one corresponding shelf.

* * * * *